US010837162B2

(12) United States Patent
Hirasawa et al.

(10) Patent No.: US 10,837,162 B2
(45) Date of Patent: Nov. 17, 2020

(54) TOILET DEVICE

(71) Applicant: LIXIL Corporation, Tokyo (JP)

(72) Inventors: Isato Hirasawa, Tokyo (JP); Saori Ichihara, Tokyo (JP); Kentarou Tsuji, Tokyo (JP); Hiroto Kutsuzawa, Tokyo (JP); Tomoya Sasaki, Tokyo (JP); Hiroaki Watanabe, Tokyo (JP); Yuji Nakayama, Tokyo (JP); Tsunaki Itou, Tokyo (JP); Miyoko Tateishi, Tokyo (JP)

(73) Assignee: LIXIL Corporation, Tokyo (JP)

( * ) Notice: Subject to any disclaimer, the term of this patent is extended or adjusted under 35 U.S.C. 154(b) by 0 days.

(21) Appl. No.: 16/090,138

(22) PCT Filed: Mar. 27, 2017

(86) PCT No.: PCT/JP2017/012295
§ 371 (c)(1),
(2) Date: Sep. 28, 2018

(87) PCT Pub. No.: WO2017/170349
PCT Pub. Date: Oct. 5, 2017

(65) Prior Publication Data

US 2019/0112797 A1 Apr. 18, 2019

(30) Foreign Application Priority Data

Mar. 29, 2016 (JP) ..... 2016-066845
Mar. 31, 2016 (JP) ..... 2016-073272

(51) Int. Cl.
*E03D 9/08* (2006.01)
*E03D 5/10* (2006.01)

(52) U.S. Cl.
CPC ..... *E03D 9/08* (2013.01); *E03D 5/105* (2013.01)

(58) Field of Classification Search
CPC ..... E03D 9/08; E03D 9/085; E03D 11/08; E03D 11/10
(Continued)

(56) References Cited

U.S. PATENT DOCUMENTS 4,389,738 A 6/1983 Ando et al.
5,455,971 A * 10/1995 Sakakibara ..... E03D 5/105 4/313
2009/0217447 A1* 9/2009 Matsushita ..... A47K 13/24 4/420.5

FOREIGN PATENT DOCUMENTS

AT 9069 U1 4/2007
EP 2261428 12/2010
(Continued)

OTHER PUBLICATIONS

International Search Report dated Jun. 20, 2017, directed to International Application No. PCT/JP2017/012295; 8 pages.
(Continued)

*Primary Examiner* — Lauren A Crane
(74) *Attorney, Agent, or Firm* — Morrison & Foerster LLP

(57) ABSTRACT

A toilet device includes a toilet main body, a base plate which is provided on an upper portion of the toilet main body and on which a functional unit is mounted, and a cover which covers the base plate from an upper side such that the functional unit is accommodated. The cover has a protrusion portion that protrudes further downward than the base plate and that is positioned closer to a toilet bowl of the toilet main body than the base plate. A recess portion, which communicates with the toilet bowl and is open to the upper side, is formed in the toilet main body. The base plate is arranged on the recess portion.

5 Claims, 14 Drawing Sheets

(58) Field of Classification Search
USPC ..... 4/420
See application file for complete search history.

(56) References Cited

FOREIGN PATENT DOCUMENTS

| | | | | |
|---|---|---|---|---|
| JP | S60-53872 | U | | 4/1985 |
| JP | 7-216969 | | | 8/1995 |
| JP | H11-81420 | A | | 3/1999 |
| JP | 2002-51941 | | | 2/2002 |
| JP | 2002-356897 | | | 12/2002 |
| JP | 2002356897 | A | * | 12/2002 |
| JP | 2003-105830 | | | 4/2003 |
| JP | 2004-116250 | | | 4/2004 |
| JP | 2004-275268 | | | 10/2004 |
| JP | 2004275268 | A | * | 10/2004 |
| JP | 2006-283396 | | | 10/2006 |
| JP | 2008-95396 | | | 4/2008 |
| JP | 2009-279256 | | | 12/2009 |
| JP | 2010-116730 | | | 5/2010 |
| JP | 2013-76216 | | | 4/2013 |
| JP | 2014-31610 | | | 2/2014 |

OTHER PUBLICATIONS

Liu. (Jun. 30, 2015). Sensor Principles, Design, and Applications. Defense Industry Press, 5th Edition. p. 144.
The Second Office Action dated Jun. 30, 2020, directed to CN Application No. 201780020572.8; 16 pages.

* cited by examiner

TOILET DEVICE

REFERENCE TO RELATED APPLICATIONS

This application is a national stage application under 35 USC 371 of International Application No. PCT/JP2017/012295, filed Mar. 27, 2017, which claims the priority of Japanese Application No. 2016-066845, filed Mar. 29, 2016, and Japanese Application No. 2016-073272, filed Mar. 31, 2016, the entire contents of each of which are incorporated herein by reference.

FIELD OF THE INVENTION

The present invention relates to a toilet device.

BACKGROUND OF THE INVENTION

A known toilet device includes a toilet main body, a base plate and a cover (for example, refer to Patent Document 1). The base plate is provided on an upper portion of the toilet main body. On the base plate, a functional unit having various functional devices such as a private part-washing device and a deodorizing device, and functional components are mounted. The functional unit has a cover that covers the functional unit from an upper side. In such a toilet device, the base plate is provided along an upper end surface of the toilet main body, and the cover is provided on an upper portion of the base plate such that the functional unit is accommodated therein.

However, if there is a gap between the toilet main body and the base plate, splashing from a toilet bowl enters into the gap, causing a problem in that cleaning becomes troublesome. In this respect, a gasket is provided in the gap between the toilet main body and the base plate to prevent splashing from entering into the gap. Even with this configuration, since splashing from the toilet bowl adheres to the gasket, the splash which has adhered to the gasket has to be cleaned, causing a problem in that cleaning becomes troublesome.

In a next exemplarily configuration, a toilet device is configured to include a toilet main body, a washing mechanism unit, and a toilet seat unit. The toilet main body includes a bowl portion and a rim portion of a toilet bowl. The washing mechanism unit is provided on a rear portion of the toilet main body. The washing mechanism unit, for example, detects a remote control operation of a user, and discharges flush water into the toilet main body. The toilet seat unit includes a toilet seat and a toilet lid.

In this exemplary constitution, the washing mechanism unit is integrally provided on the rear portion of the toilet main body in an attachable/detachable manner. The washing mechanism unit is accommodated inside a cover case. The washing mechanism unit includes an opening/closing valve such as an electromagnetic valve and a control valve that control opening and closing of a flush water flow channel via a remote control operation. Using this opening/closing valve, the washing mechanism unit performs functions of switching between rim water discharging and jet water discharging, and controlling the flow rate of the discharging water. In the rim water discharging, the flush water flows in the rim portion of the toilet main body. In the jet water discharging, the flush water flows in the bowl portion of the toilet main body and in a water sealing portion.

The cover case is configured to include a base (base plate) which is installed on an upper surface of the rear portion of the toilet main body, and a cover (outer shell body) which is assembled in the base and forms an accommodation space.

Generally, a toilet device including a private part-washing device, a warm air drying device, and the like is configured to accommodate the private part-washing device, the warm air drying device, and the like together with the washing mechanism unit in the cover case.

On the other hand, there is a toilet device including a human body detection sensor which causes a toilet lid to be automatically opened and closed and causes a washing mechanism unit or the like to be driven when the sensor detects a person, such as a user using the toilet device, as the person enters or leaves a bathroom. The human body detection sensor such as a pyroelectric sensor is installed to be accommodated inside a cover case. The human body detection sensor is configured to detect a human body through a sensor window attached to an opening portion formed to penetrate the cover case (for example, refer to Patent Document 2).

Here, in a toilet device in the related art, in order to make logos of a manufacturer, a product name, and the like noticeable, the logos are often provided on an upper surface in the middle of a cover case in a width direction so that the logos easily come into sight of a user, and in order to make a sensor window unnoticeable as much as possible, the sensor window is often provided on a side portion of the cover case in the width direction.

Accordingly, various logos such as a brand logo and a product logo, and the sensor window independently function and are individually provided in a scattered manner, so that it is difficult to establish a uniformity in the sense of design, and sometimes a poor quality of the design is caused.

Since the sensor window is provided on the side portion of the cover case in the width direction in order to make the sensor window unnoticeable as much as possible, the detection range (the center of the detection range) of the human body detection sensor is positioned in an oblique area starting from the side portion of the toilet device in the width direction and shifting toward the center in the width direction as the range extends to the front of the toilet device. That is, the range of human detection is set to obliquely intersect with the orientation of a user or the like when the user is facing the toilet device from the center position in front of the toilet device. Therefore, in regard to the detection range, compared to a case where the detection range is set forward from the center of the toilet device, the detection accuracy becomes lower.

Moreover, in an exemplary related art, in order to reduce the visible area size of the sensor window as much as possible, the sensor window is attached to an opening portion, which is formed to penetrate the cover case from the outer surface to the inner surface, by fitting the sensor window into the opening portion from the inner surface of the cover case. This configuration requires a holding member or the like on the inner surface of the cover case which prevents the sensor window from being dislocated even if the sensor window attached from the inner surface of the cover case is pressed from the outer surface side of the cover case.

The connecting portion between the circumferential end of the opening portion in the cover case and the outer circumference of the sensor window fitted into the opening portion may cause a poor visual impression, if this connecting portion is exposed without any cover. Therefore, it is also necessary to ensure the attractive appearance by separately attaching a decorative member covering the connecting portion, from the outer surface side of the cover case.

Consequently, there are disadvantages in that the number of members increases and attaching work of the sensor window becomes complicated.

CITATION LIST

Patent Literature

PATENT DOCUMENT 1 Japanese Unexamined Patent Application, First Publication No. 2003-105830

PATENT DOCUMENT 2 Japanese Unexamined Patent Application, First Publication No. 2013-076216

SUMMARY OF THE INVENTION

The present invention has been made in consideration of the problems described above, and a first object thereof is to provide a toilet device in which cleaning can be easily performed.

A second object of the present invention is to provide a toilet device in which a sensor window of a human body detection system having favorable appearance can be provided.

In order to achieve the foregoing objects, the present invention provides the following means.

According to a first aspect of the present invention, a toilet device is provided, including a toilet main body, a base plate which is provided on an upper portion of the toilet main body and on which a functional unit is mounted, and a cover which covers the base plate from an upper side such that the functional unit is accommodated. The cover has a protrusion portion that protrudes further downward than the base plate and that is positioned closer to a toilet bowl of the toilet main body than the base plate.

In the present invention, the cover has the protrusion portion that protrudes at a position closer to the toilet bowl of the toilet main body than the base plate and protrudes further downward than the base plate. Therefore, the protrusion portion is positioned closer to the toilet bowl than the gap between the base plate and the toilet main body. Because of this configuration, the protrusion portion can prevent the splashing coming from the toilet bowl from entering into the gap between the toilet main body and the base plate. As a result, cleaning can be easily performed.

In the toilet device according to a second aspect of the present invention, a recess portion, which communicates with the toilet bowl and is recessed downward than an upper end surface of the toilet main body, may be formed in the toilet main body. The base plate may be arranged on the recess portion.

In such a configuration, compared to a case where the base plate is mounted on the upper end surface of the toilet main body, the base plate can be installed at a lower position. Therefore, installation positions of the base plate, the functional unit, and the cover can be lowered, so that a toilet device having a compact design can be realized.

In such a configuration, compared to a case where the base plate is mounted on the upper end surface of the toilet main body, the position of the gap between the toilet main body and the base plate is lowered. Accordingly, splashing from the toilet bowl is more likely to enter into the gap. However, since the protrusion portion is arranged at a position closer to the toilet bowl than the gap between the base plate and the toilet main body, even though the position of the gap between the toilet main body and the base plate is lowered, the protrusion portion can prevent splashing coming from the toilet bowl from entering into the gap between the toilet main body and the base plate.

In the toilet device according to a third aspect of the present invention, a gasket may be provided in a gap between the toilet main body and the base plate. The protrusion portion may be arranged at a position closer to the toilet bowl of the gasket.

In such a configuration, the protrusion portion and the gasket can prevent splashing coming from the toilet bowl from entering into the gap between the toilet main body and the base plate.

The protrusion portion is arranged at a position closer to the toilet bowl than the gasket. Therefore, since the protrusion portion can prevent splashing from the toilet bowl onto the gasket, it is possible to minimize splashing from the toilet bowl contaminating the gasket.

Moreover, since the protrusion portion is arranged at a position closer to the toilet bowl than the gasket, it is difficult for a user to see the gasket, so that the aesthetic appearance can be improved.

In the toilet device according to a fourth aspect of the present invention, the functional unit may have a private part-washing device. The private part-washing device may have a shutter provided at a position facing the toilet bowl. A cut-out portion, in which the shutter is arranged, may be formed in the protrusion portion.

This configuration can prevent the protrusion portion from interfering with the shutter of the private part-washing device.

According to a fifth aspect of the present invention, a toilet device is provided, including a human body detection system that includes a sensor window which is installed by being fitted into a sensor window attachment portion having an opening portion formed to penetrate an outer shell body, and a human body detection sensor which detects a person through a translucent sensor window portion covering the opening portion for the sensor window and is installed inside the outer shell body. A mark to be visually recognized by a person is provided on the sensor window portion.

In the toilet device according to a sixth aspect of the present invention, the sensor window may be formed to include a decorative portion installed along a connecting portion between the sensor window and the sensor window attachment portion of the outer shell body.

In the toilet device according to a seventh aspect of the present invention, the sensor window portion may be installed to protrude outward from a surface of the outer shell body.

In the toilet device according to an eighth aspect of the present invention, the sensor window may be provided on an upper surface and at a center of a cover case in a width direction in a width direction, the cover case constituting the outer shell body of the toilet device.

In the toilet device according to a ninth aspect of the present invention, the sensor window may be fitted into the sensor window attachment portion from the outer side of the outer shell body.

According to the first to fourth aspects of the present invention described above, cleaning can be easily performed.

According to the fifth to ninth aspects of the present invention described above, a mark such as a logo is formed in the sensor window portion of the sensor window. Therefore, it is possible to integrally provide the sensor window together with marks such as a brand logo and a product logo which have been individually scattered and have independently functioned in the related art. Accordingly, the design of the appearance can be improved.

Thus, according to the fifth to ninth aspects of the present invention, it is possible to provide a sensor window of the human body detection system having favorable appearance.

DETAILED DESCRIPTION OF THE INVENTION

Hereinafter, a toilet device according to an embodiment A of the present invention will be described based on FIG. 1 to FIG. 12.

Figure 1:
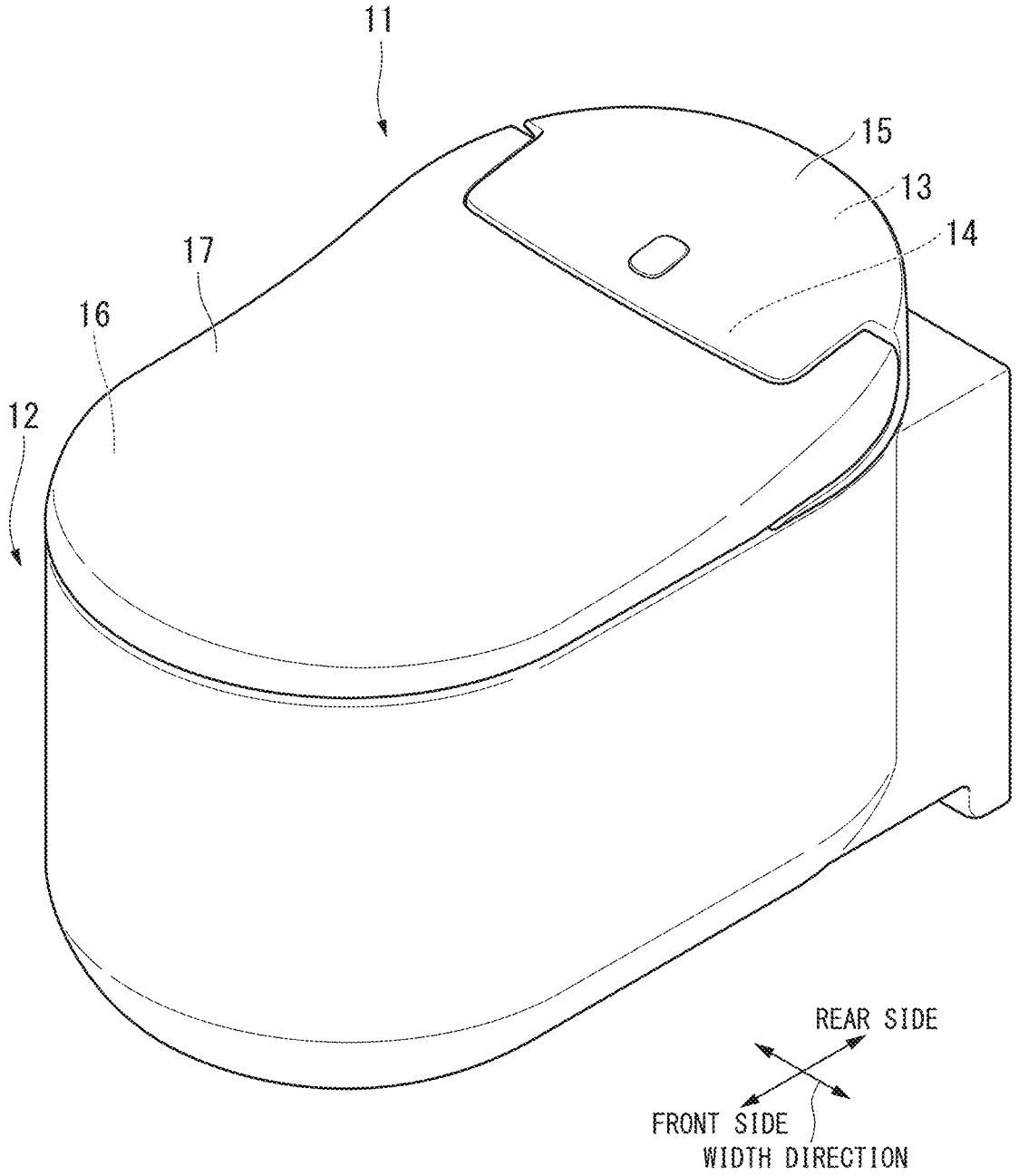
FIG. 1 is a perspective view illustrating an example of a toilet device according to an embodiment A of the present invention.
Figure 2:
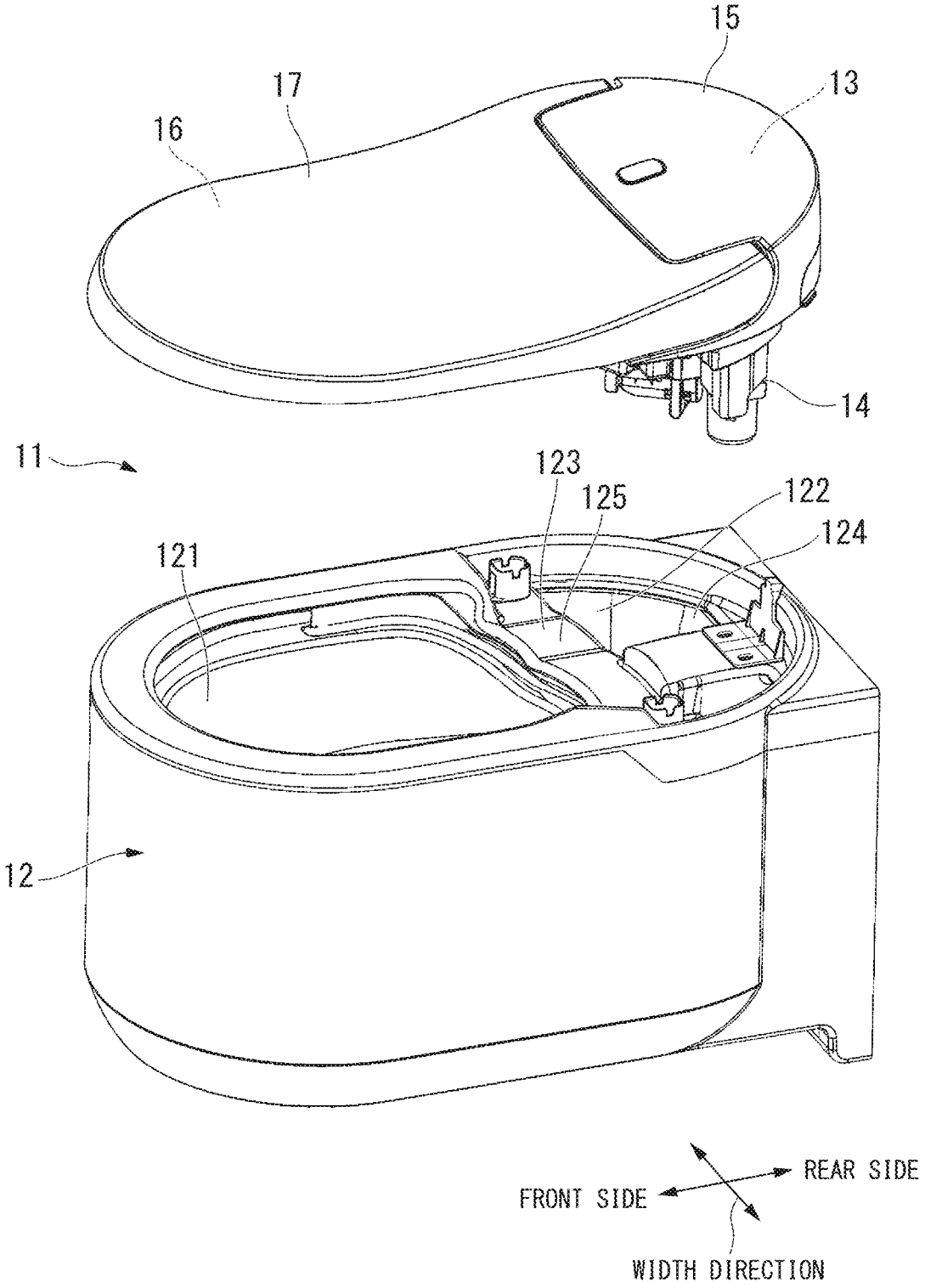
FIG. 2 is a perspective view describing a functional unit installation space of embodiment A of the present invention.

As shown in FIG. 1 and FIG. 2, a toilet device 11 according to the present embodiment A has a toilet main body 12, a base plate 14, and a cover 15.

A toilet bowl 121 is formed in the toilet main body 12. The base plate 14 is provided on an upper portion of the toilet main body 12, and a functional unit 13 is mounted on the base plate 14. The cover 15 covers the base plate 14 from above such that the functional unit 13 is accommodated. The toilet device 11 has a toilet seat 16 and a toilet lid 17. The toilet seat 16 and the toilet lid 17 are provided on the upper portion of the toilet main body 12 and are supported by the functional unit 13 in a pivotable manner.

The functional unit 13 has various functional devices such as a private part-washing device 131 (refer to FIG. 4), a deodorizing device, and an opening/closing device which opens and closes the toilet seat 16 and the toilet lid 17; functional components; and the like.

A side of the toilet device 11 on which the functional unit 13 is provided will be referred to as the rear side in the forward/rearward direction. A side on which the toilet seat 16 is provided will be referred to as a front side in the forward/rearward direction. A horizontal direction orthogonal to the forward/rearward direction will be referred to as a width direction. The direction toward both end portions with respect to the center portion in the width direction will be referred to as outward. The direction toward the center portion with respect to the both end portions will be referred to as inward.

As shown in FIG. 2, the substantially oval-shaped toilet bowl 121 of which the shape in plan view is elongated in the forward/rearward direction is formed in a part of the toilet main body 12 on the front part. A functional unit installation space 122, in which the functional unit 13 is installed, is formed on the rear part of the toilet bowl 121 of the toilet main body 12.

A recess portion 125, which is recessed downward than an upper end surface of the toilet main body 12 and is open toward upward and toward forward, is formed at an intermediate portion in the width direction of a front part 123 of the functional unit installation space 122. In a state where the functional unit 13 is not installed, the recess portion 125 communicates with the toilet bowl 121 in the forward/rearward direction. The upper end surface of the toilet main body 12 is connected to both sides of the recess portion 125 in the width direction.

A rear part 124 of the functional unit installation space 122 is formed in the toilet main body 12 substantially in its entirety in a height direction, and a bottom portion thereof also serves as a bottom portion of the toilet main body 12.

A front edge portion of the functional unit installation space 122 is curved to protrude backwards along a rear portion of the inner surface of the toilet bowl 121.

Figure 3:
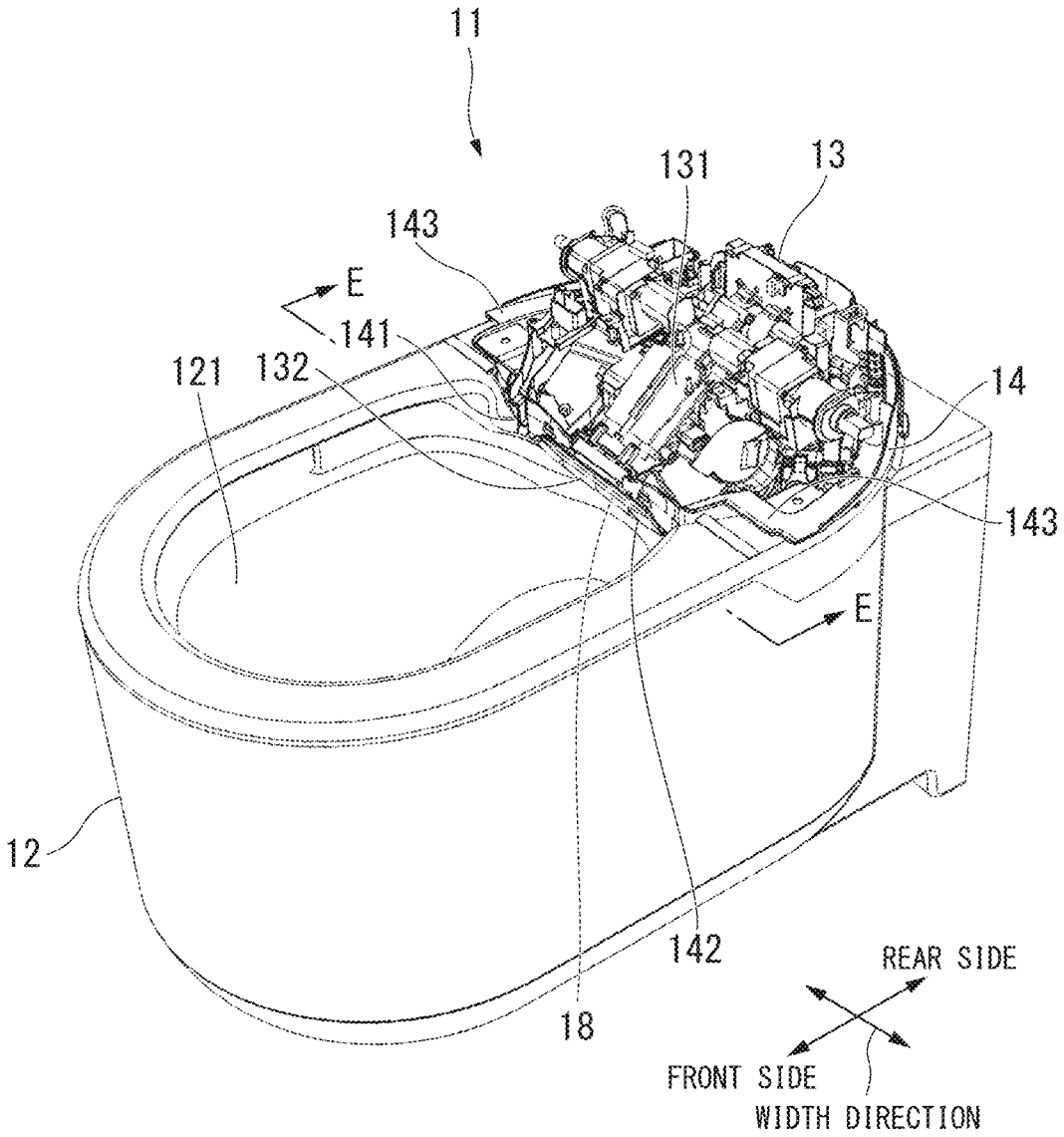
FIG. 3 is a perspective view describing a base plate and a functional unit of embodiment A of the present invention.

As shown in FIG. 3, the base plate 14 is provided on the functional unit installation space 122 (refer to FIG. 2). A front part 141 of the base plate 14 is installed on the front part 123 of the functional unit installation space 122 (refer to FIG. 2). The front part 141 of the base plate 14 has an inner plate portion 142 positioned in the intermediate portion in the width direction, and a pair of outer plate portions 143 and 143 each connected to both sides of the inner plate portion 142 in the width direction.

The inner plate portion 142 is formed into a plate shape recessed downward along the recess portion 125 of the functional unit installation space 122. The pair of outer plate portions 143 and 143 is formed into a flat plate shape along the upper end surface of the toilet main body 12 and is each connected to both sides of the recess portion 125 in the width direction.

The front-end portion of the pair of outer plate portions 143 and 143 are arranged rearward than the front-end portion of the inner plate portion 142.

In embodiment A, a shutter 132 of the private part-washing device 131 is arranged on an upper part in the vicinity of the front edge portion of the inner plate portion 142. The shutter 132 is formed into a plate shape. The shutter 132 is configured to be pivotable about a pivot shaft extending in the width direction.

In embodiment A, a gasket 18 is provided between the front part 141 of the base plate 14 and the recess portion 125 (refer to FIG. 3 and FIG. 8 to FIG. 10).

As shown in FIGS. 4 to 7, the cover 15 has an upper plate portion 151, a rear plate portion 152, a pair of side plate portions 153 and 153, a pair of connection plate portions 154 and 154, a lower plate portion 156, and a protrusion portion 157.

Figure 4:
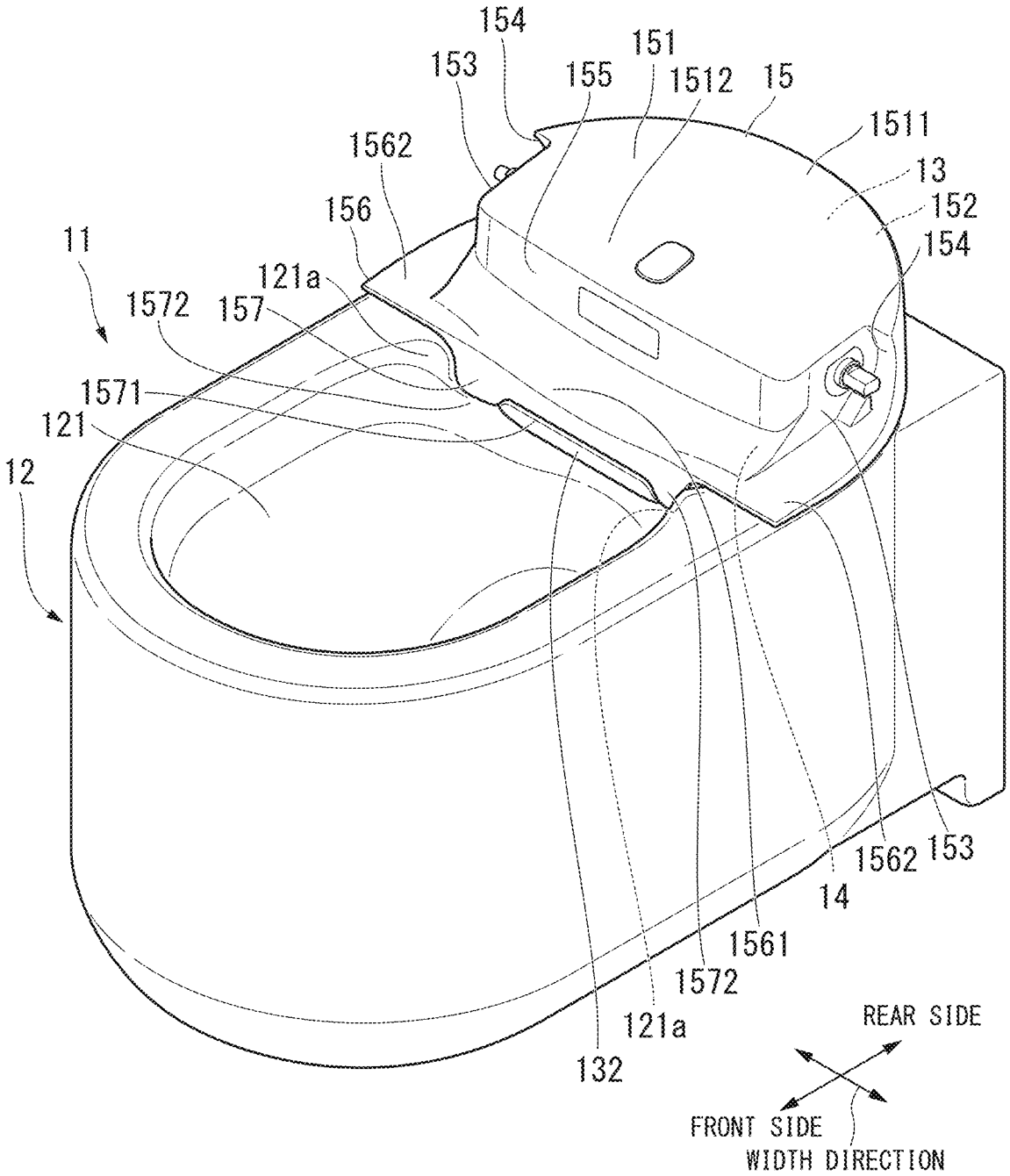
FIG. 4 is a perspective view describing a cover of embodiment A of the present invention.
Figure 5:
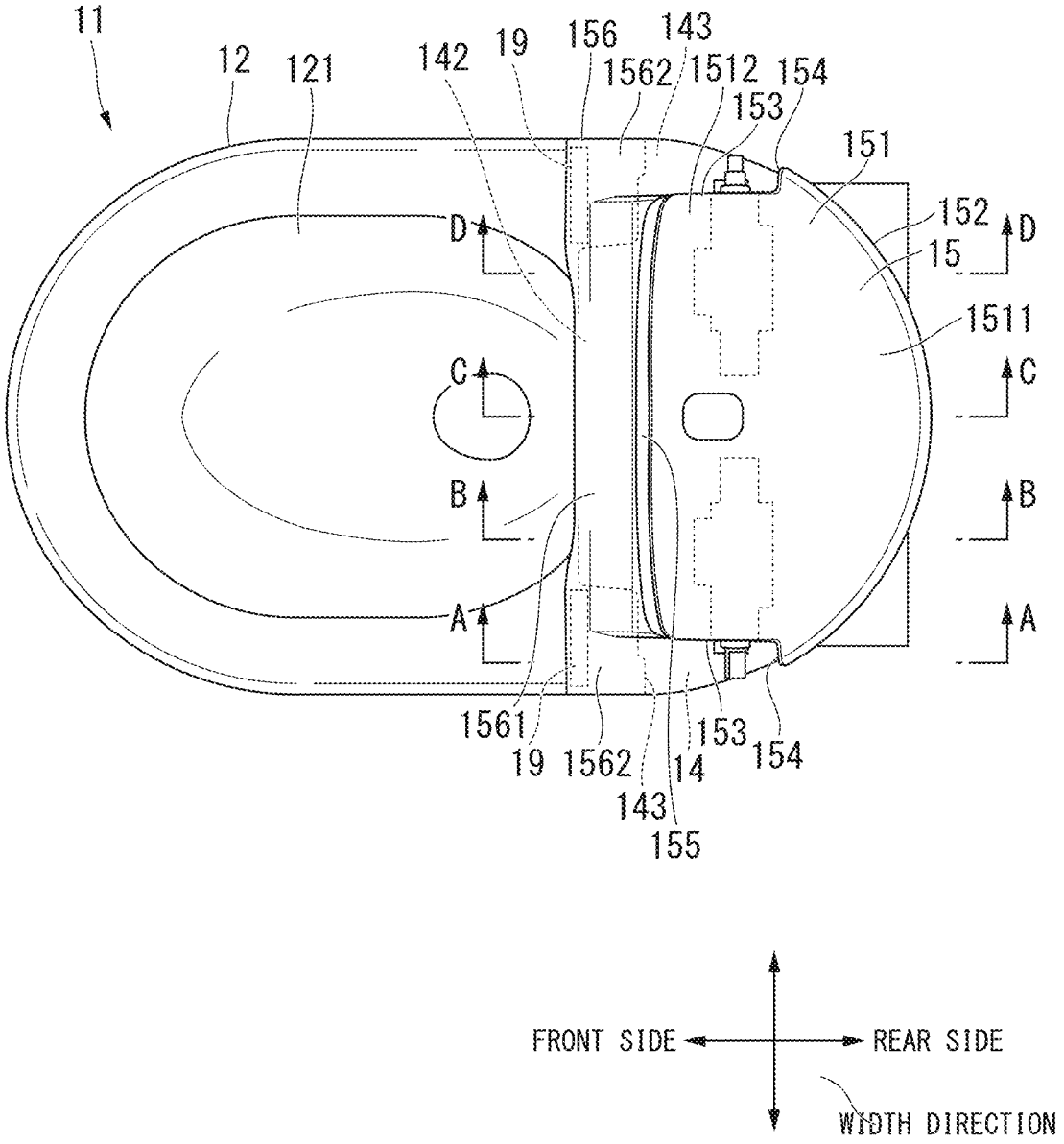
FIG. 5 is a view of the cover of embodiment A of the present invention seen from above.
Figure 6:
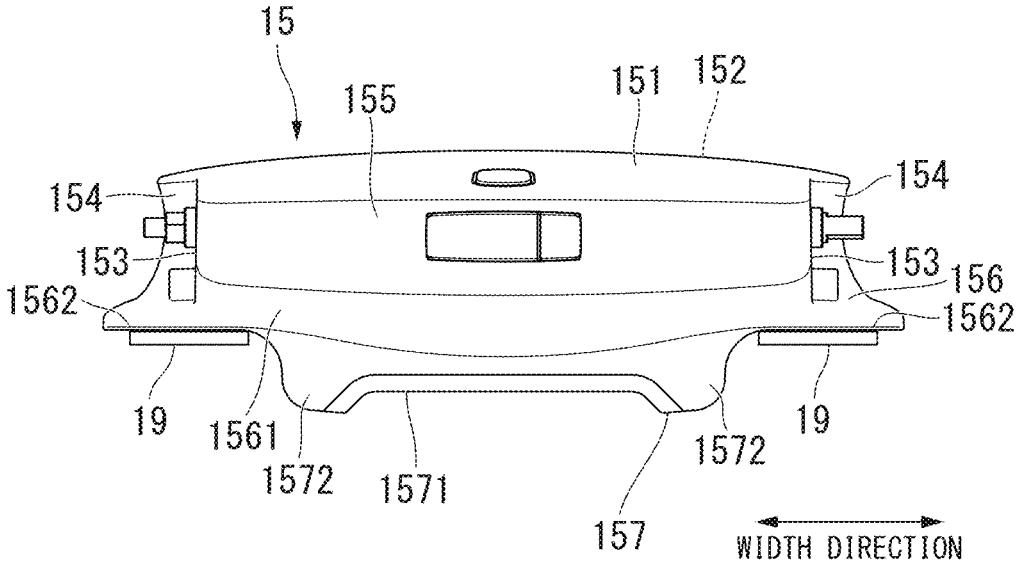
FIG. 6 is a view of the cover of embodiment A of the present invention seen from the front.
Figure 7:
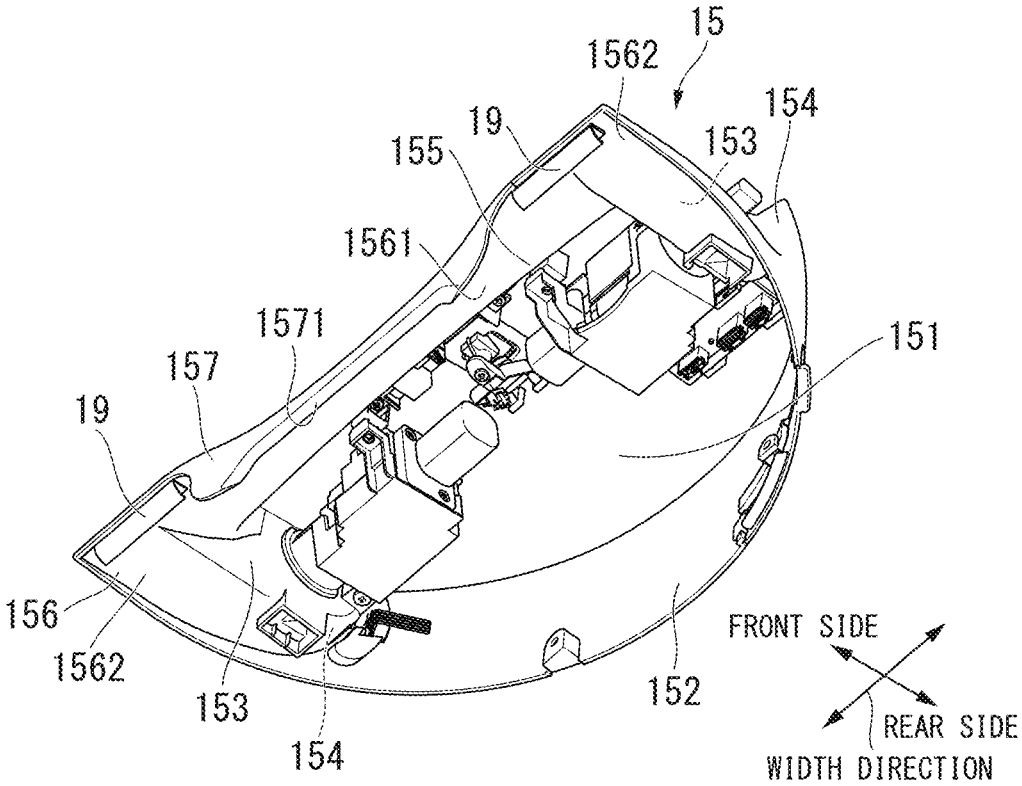
FIG. 7 is a view of the cover of embodiment A of the present invention seen from below.

The upper plate portion 151 is arranged over the functional unit 13 (refer to FIG. 4 and FIG. 5). The rear plate portion 152 extends downwards from the rear edge portion of the upper plate portion 151. The pair of side plate portions 153 and 153 each extends downward from the edge portions on both sides of the upper plate portion 151 in the width direction. The pair of connection plate portions 154 and 154 connects the outer edge portion of the rear plate portion 152 in the width direction and the rear edge portions of the pair of side plate portions 153 and 153 to each other. A front plate portion 155 extends downward from the front edge portion of the upper plate portion 151. The lower plate portion 156 extends forward from lower end portions of the pair of connection plate portions 154 and 154 and the front plate portion 155. The protrusion portion 157 is formed into a plate shape protruding downward from the front edge portion of the lower plate portion 156.

A rear part 1511 of the upper plate portion 151 is formed into a substantially semicircular shape curved to protrude rearward in the plan view. A front part 1512 of the upper plate portion 151 is formed into a substantially rectangular shape elongated in the width direction in the plan view. The rear part 1511 of the upper plate portion 151 is formed to have dimensions in the width direction greater than those of the front part 1512. The rear part 1511 of the upper plate portion 151 protrudes outward in the width direction from the front part 1512.

The pair of connection plate portions 154 and 154 extends downward from parts protruding outward in the width direction from the front part 1512 of the rear part 1511 of the upper plate portion 151.

The lower plate portion 156 surrounds the pair of side plate portions 153 and 153 and the front plate portion 155. The lower plate portion is formed into a substantially C-shape being open rearward in the plan view. When the cover 15 is arranged at a normal position with respect to the toilet main body 12 and the base plate 14, both end portions of the lower plate portion 156 in the width direction are arranged substantially right above both end portions of the toilet main body 12 in the width direction. In the lower plate portion 156, an intermediate part in the width direction extending forward from the lower end portion of the front plate portion 155 constitutes an inner side lower plate portion 1561, and parts in the vicinity of both end portions in the width direction extending forward from the lower end portions of the pair of connection plate portions 154 and 154 constitute a pair of outer lower plate portions 1562 and 1562.

Figure 8:
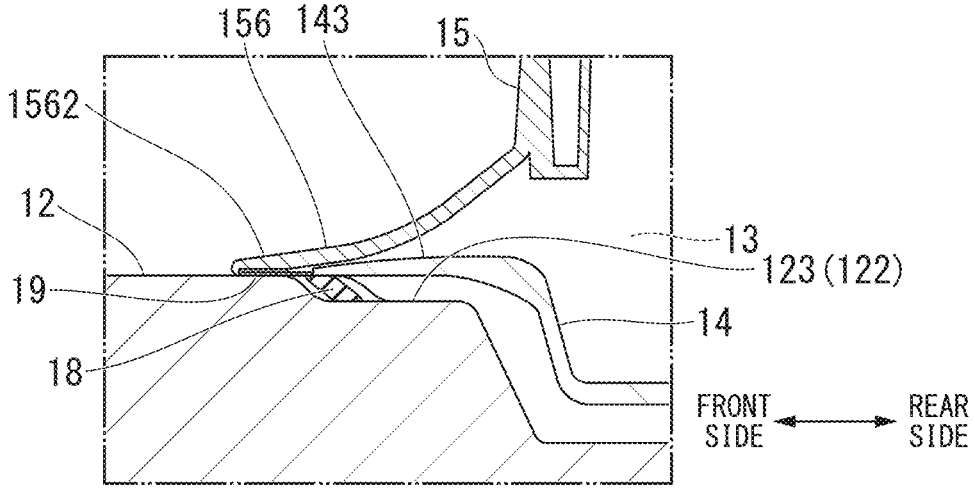
FIG. 8 is a cross-sectional view taken along line A-A in FIG. 5.

As shown in FIG. 5 and FIG. 8, the pair of outer lower plate portions 1562 and 1562 each covers upper surfaces of the pair of outer plate portions 143 and 143 of the base plate 14. The front edge portions of the pair of outer lower plate portions 1562 and 1562 are arranged forward than the front edge portions of the pair of outer plate portions 143 and 143.

Gasket 19 and 19 are provided on a lower surface in the vicinity of the front edge portion of the pair of outer lower plate portions 1562 and 1562. The gaskets 19 are arranged in a state of being interposed between the pair of outer lower plate portions 1562 and 1562 and the upper end surface of the toilet main body 12.

Figure 9:
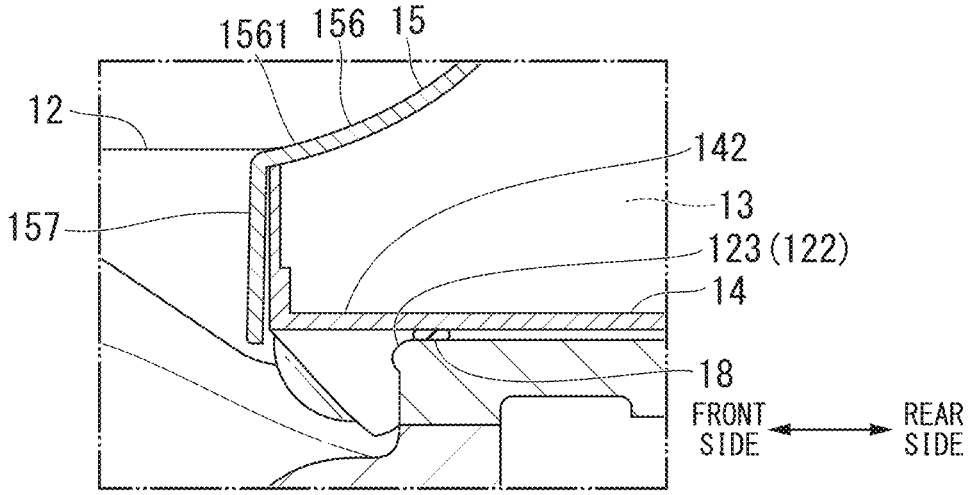
FIG. 9 is a cross-sectional view taken along line B-B in FIG. 5.

As shown in FIG. 5 and FIG. 9, the inner lower plate portion 1561 is arranged above the inner plate portion 142 of the base plate 14 so as to accommodate the functional unit 13 (refer to FIG. 5). The front edge portion of the inner side lower plate portion 1561 is arranged slightly forward (closer to the toilet bowl 121) than the front edge portion of the inner plate portion 142 of the base plate 14 and the front edge portion of the functional unit installation space 122.

Figure 10:
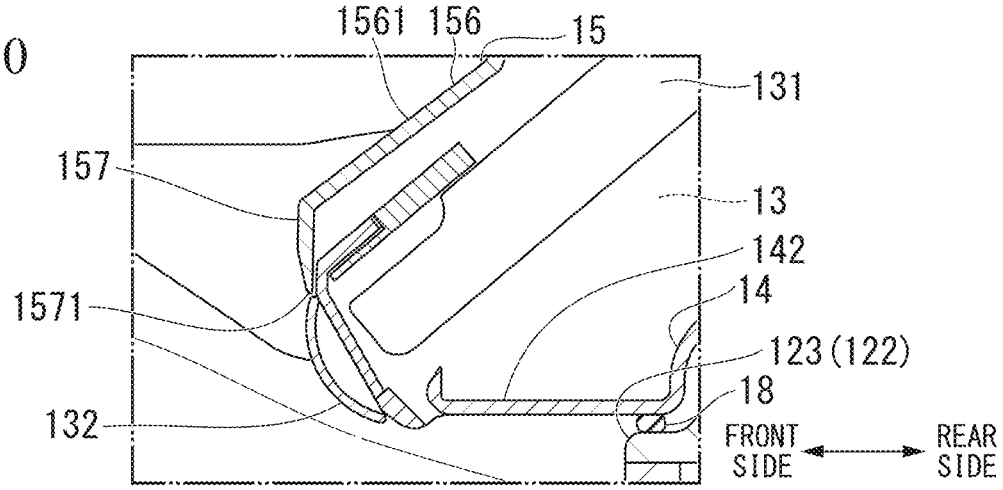
FIG. 10 is a cross-sectional view taken along line C-C in FIG. 5.

As shown in FIG. 4, FIG. 9, and FIG. 10, the protrusion portion 157 protrudes downward from the front edge portion of the inner side lower plate portion 1561 and is arranged in front of the front end portion of the inner plate portion 142 of the base plate 14. A cut-out portion 1571 exposing the shutter 132 of the private part-washing device 131 through the intermediate portion in the width direction is formed in the protrusion portion 157. When the shutter 132 is in a closed state, a front surface of the shutter 132 and a front surface of the protrusion portion 157 are arranged to be substantially continuous with each other or to be substantially co-planer with each other.

Figure 11:
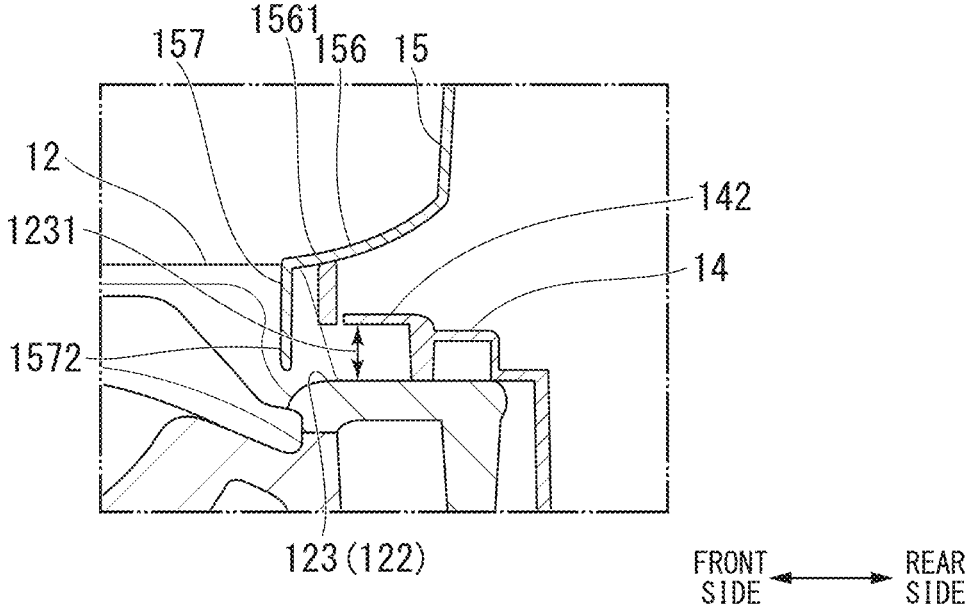
FIG. 11 is a cross-sectional view taken along line D-D in FIG. 5.
Figure 12:
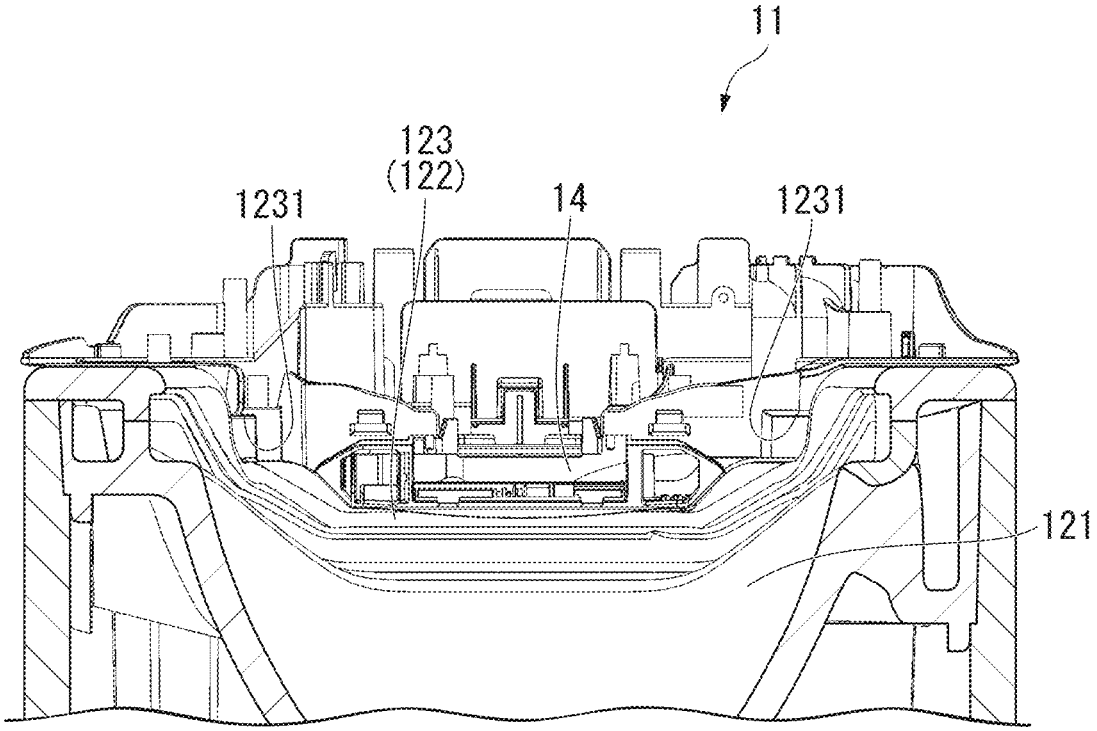
FIG. 12 is a cross-sectional view taken along line E-E in FIG. 3, and a functional unit of embodiment A of the present invention is omitted in the diagram.

As shown in FIG. 11, in the cut-out portion 1571, an outer part 1572 in the width direction than a part in which the cut-out portion 1571 (refer to FIG. 4) is formed to extend downward than the front end portion of the inner plate portion 142 of the base plate 14 which the part 1572 faces in the forward/rearward direction, thereby the outer parts 1571 and 1572 hide the gaps 1231 and 1231 (refer to FIG. 11 and FIG. 12) between the base plate 14 and the part 123 of the functional unit installation space 122 on the front side from the front side.

The front surface of the protrusion portion 157 is arranged to be substantially continuous with or substantially co-planer with a part 121*a* of the inner surface of the toilet bowl 121 adjacent to the protrusion portion 157 in the width direction (refer to FIG. 4).

Next, operations and effects of the toilet device according to embodiment A will be described by using the drawings.

In the toilet device 11 according to embodiment A described above, the cover 15 has the protrusion portion 157 which protrudes at a position further forward (closer to the toilet bowl 121) along the forward direction with respect to the toilet main body 12 than the base plate 14. The protrusion portion 157 protrudes further downward than the upper end surface of the toilet main body 12. Accordingly, the protrusion portion 157 is arranged in front of a gap between the base plate 14 and the toilet main body 12. Therefore, the protrusion portion 157 can prevent splashing coming from the toilet bowl 121 from entering into the gap between the toilet main body 12 and the base plate 14. As a result, cleaning can be easily performed.

The recess portion 125, which communicates with the toilet bowl 121 and is recessed downward than the upper end surface of the toilet main body 12, is formed in the toilet main body 12, and the base plate 14 is arranged on the recess portion 125. Accordingly, compared to a case where the base plate 14 is mounted on the upper end surface of the toilet main body 12, the base plate 14 can be installed at a low position. Therefore, installation positions of the base plate 14, the functional unit 13, and the cover 15 can be lowered, so that a toilet device 11 having compact design can be realized.

In the toilet device 11 according to embodiment A, compared to a case where the base plate 14 is mounted on the upper end surface of the toilet main body 12, the position of the gap between the toilet main body 12 and the base plate 14 is lowered. Accordingly, splashing from the toilet bowl 121 is more likely to enter into the gap. However, since the protrusion portion 157 is arranged in front of the gap between the base plate 14 and the toilet main body 12, even though the position of the gap between the toilet main body 12 and the base plate 14 is lowered, the protrusion portion 157 can prevent splashing coming from the toilet bowl 121 from entering into the gap between the toilet main body 12 and the base plate 14.

The gaskets 19 are provided in the gap between the toilet main body 12 and the base plate 14, and the protrusion portion 157 is arranged in front of the gaskets 19. Accordingly, the protrusion portion 157 and the gaskets 19 can more reliably prevent splashing from the toilet bowl 121 from entering into the gap between the toilet main body 12 and the base plate 14.

Since the protrusion portion 157 minimizes the amount of splashing from the toilet bowl 121 scattered onto the gaskets 19, it is possible to minimize splashing from the toilet bowl 121 contaminating the gaskets 19.

Moreover, since the gaskets 19 are not apparent from the user, aesthetic appearance can be improved.

The functional unit 13 has the private part-washing device 131 having the shutter 132 provided at a position facing the toilet bowl 121, and the cut-out portion 1571, in which the shutter 132 is arranged, is formed in the protrusion portion 157. This configuration can prevent the protrusion portion 157 from interfering with the shutter 132 of the private part-washing device 131.

Hereinabove, embodiment A of the toilet device according to the present invention has been described. However, the present invention is not limited to embodiment A and can be suitably changed within a range not departing from the gist thereof.

For example, in embodiment A, the recess portion 125 is formed in the installation space for the functional unit 13 in the toilet main body 12, and the base plate 14 and the functional unit 13 are arranged in the recess portion 125. However, the installation space may be formed on a flat surface, instead of forming a recess portion 125.

In embodiment A, the gaskets 19 are provided in the gap between the toilet main body 12 and the base plate 14. However, the gaskets 19 do not have to be provided. The protrusion portion 157 does not have to be arranged on the front side of the gaskets 19.

In embodiment A, the private part-washing device 131 is provided in the functional unit 13, and the cut-out portion 1571, in which the shutter 132 of the private part-washing device 131 is arranged, is formed in the protrusion portion 157. However, the private part-washing device 131 does not have to be provided in the functional unit 3, and the cut-out portion 1571 in which the shutter 132 is arranged does not have to be formed in the protrusion portion 157.

In embodiment A, the protrusion portion 157 formed into a plate shape is provided. However, the form of the protrusion portion 157 may be suitably arranged.

In embodiment A, the gasket 18 is provided between the pair of outer plate portions 143 and 143 of the cover 15 and the upper end surface of the toilet main body 12. However, the gasket 18 does not have to be provided.

Hereinafter, with reference to FIG. 13 to FIG. 18, a toilet device according to an embodiment B of the present invention will be described.

Figure 13:
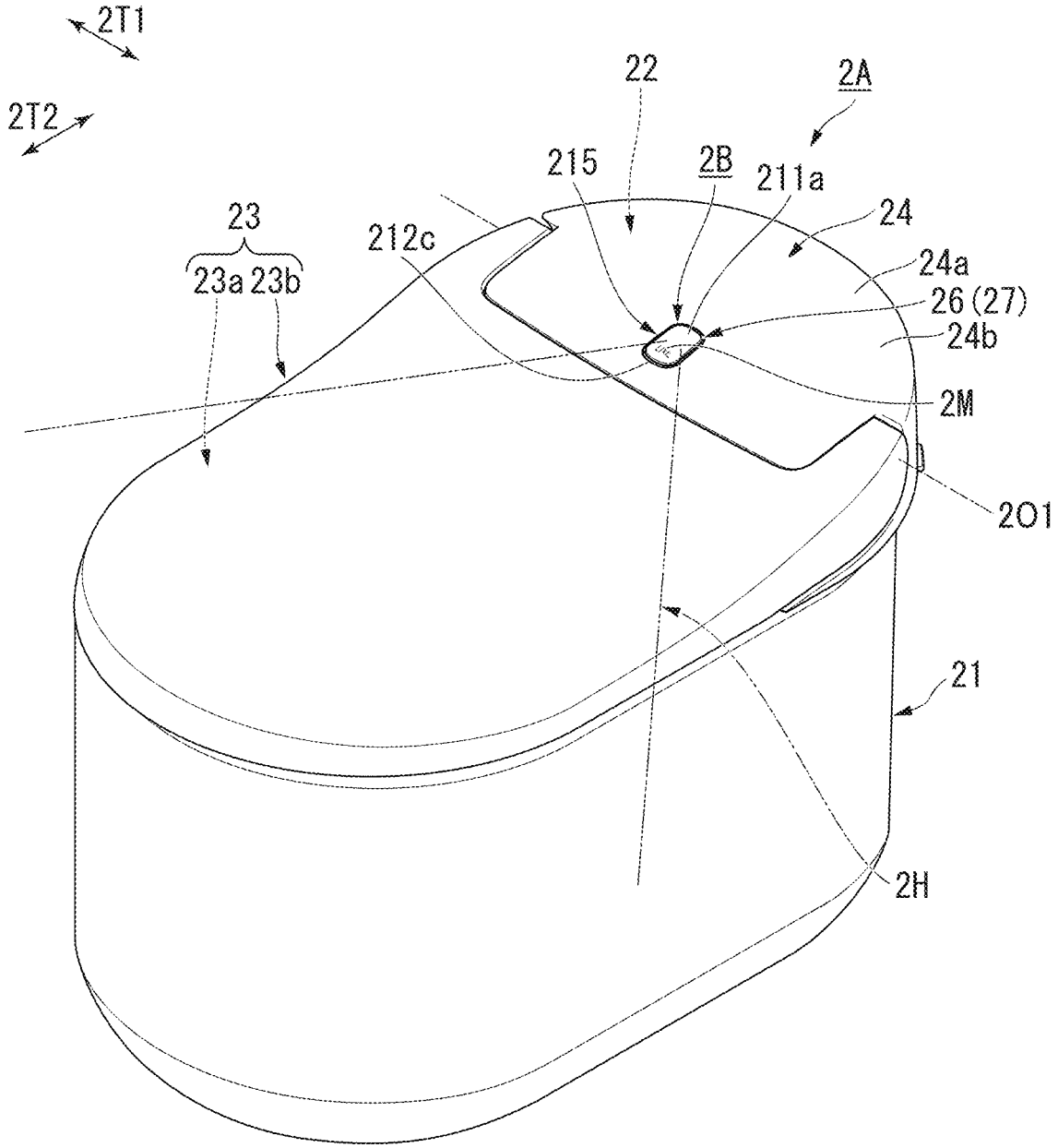
FIG. 13 is a perspective view illustrating a toilet device according to an embodiment B of the present invention.

As shown in FIG. 13, a toilet device 2A of embodiment B is configured to include a toilet main body 21, a washing mechanism unit 22, and a toilet seat unit 23.

The washing mechanism unit 22 is provided on the rear portion of the toilet main body 21, and configured to, for example, detect a remote control operation of a user, and to discharge flush water into the toilet main body 21. The toilet seat unit 23 is configured including a toilet seat 23*a* and a toilet lid 23*b*.

The washing mechanism unit 22 is integrally provided on the rear portion of the toilet main body 21 in an attachable/detachable manner and is provided to be accommodated inside a cover case 24. For example, the washing mechanism unit 22 includes an opening/closing valve such as an electromagnetic valve and a control valve that control opening and closing of a flush water flow channel through a remote control operation. The washing mechanism unit 22 is configured to perform switching between rim water discharging and jet water discharging. In the rim water discharging, flush water flows in a rim portion of the toilet main body 21. In the jet water discharging, flush water flows in a bowl portion of the toilet main body 21 and in a water sealing portion. The washing mechanism unit 22 is configured to also perform controlling of the flow rate of discharging water, by using the opening/closing valve.

The cover case 24 is configured to include a base (base plate) and a cover (outer shell body) 24*a*. The base is installed on the upper surface of the rear portion of the toilet main body 21. The cover 24*a* is assembled in the base and forms an accommodation space.

The toilet seat unit 23 is connected to the cover case 24 in an attachable/detachable manner and is provided to be pivotable around a pivot shaft 2O1 (upward/downward direction). The pivot shaft extends in a width direction 2T1 which is the traverse direction.

The toilet device 2A of embodiment B is provided with a human body detection system 2B which causes the toilet lid 23*b* to be automatically opened and closed and causes the washing mechanism unit 22 or the like to be driven when the system detected, for example, a person such as a user, as the person enters or leaves the bathroom.

Figure 14:
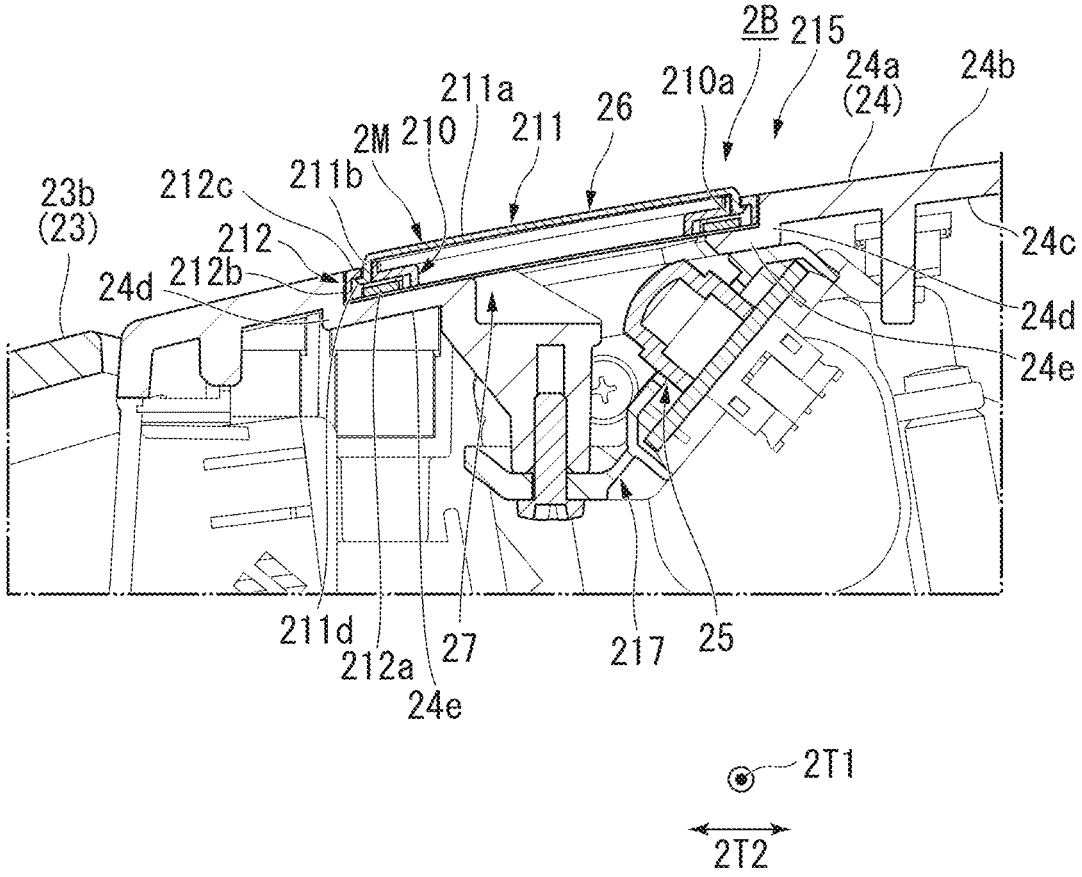
FIG. 14 is a cross-sectional view illustrating a sensor window attachment portion of the toilet device according to embodiment B of the present invention.

As shown in FIG. 13 and FIG. 14, the human body detection system 2B of embodiment B is configured to include a human body detection sensor 25 such as a pyroelectric sensor, and a sensor window 26. In embodiment B, the human body detection system 2B is provided on in front of the cover case 24 (toward the forward direction along a forward/rearward direction 2T2) and at the center of the toilet device 2A in the width direction 2T1.

The sensor window 26 is attached to an opening portion 27 formed to penetrate the cover case 24 from the upper surface (outer surface) 24*b* to the lower surface (inner surface) 24*c* at the center thereof in the width direction 2T1. The sensor window 26 is installed in order to allow heat energy (infrared light) radiated from, for example, a human body to be transmitted therethrough and to be transferred to and detected by the human body detection sensor 25 provided inside the cover case 24.

Figure 15:
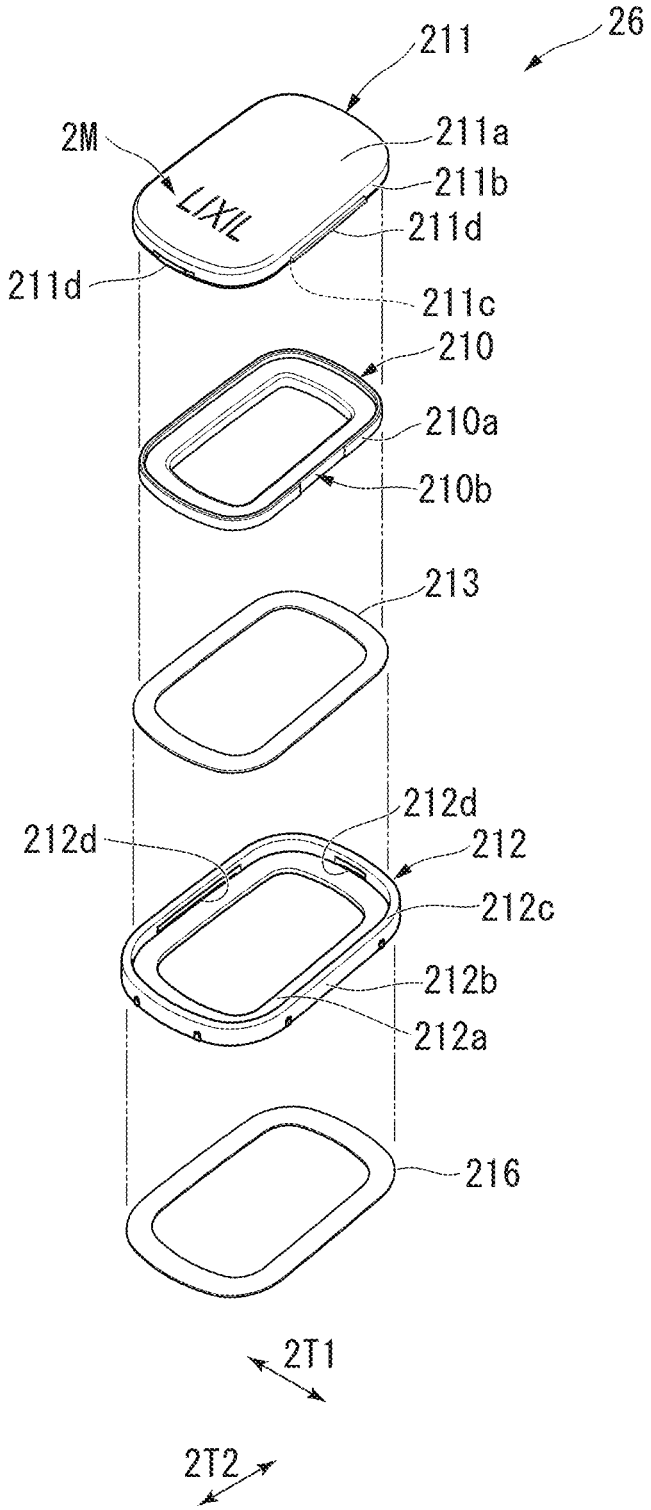
FIG. 15 is an exploded perspective view illustrating a sensor window according to embodiment B of the present invention.
Figure 16A:
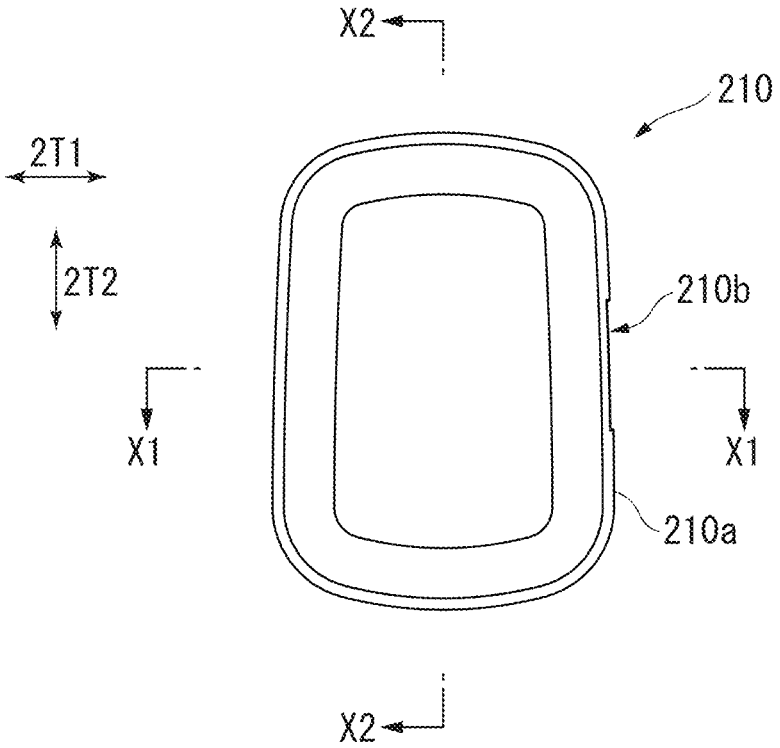
FIG. 16A is a plan view illustrating a window-holding member of the sensor window according to embodiment B of the present invention.
Figure 16B:
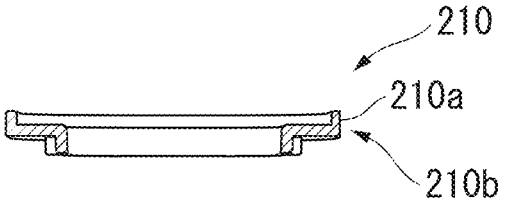
FIG. 16B is a view seen along the X1-X1 line arrow in FIG. 16A.
Figure 16C:
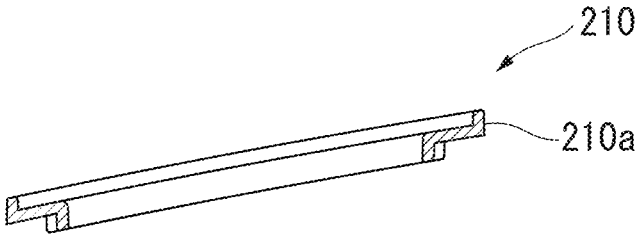
FIG. 16C is a view seen along the X2-X2 line arrow in FIG. 16A.
Figure 17A:
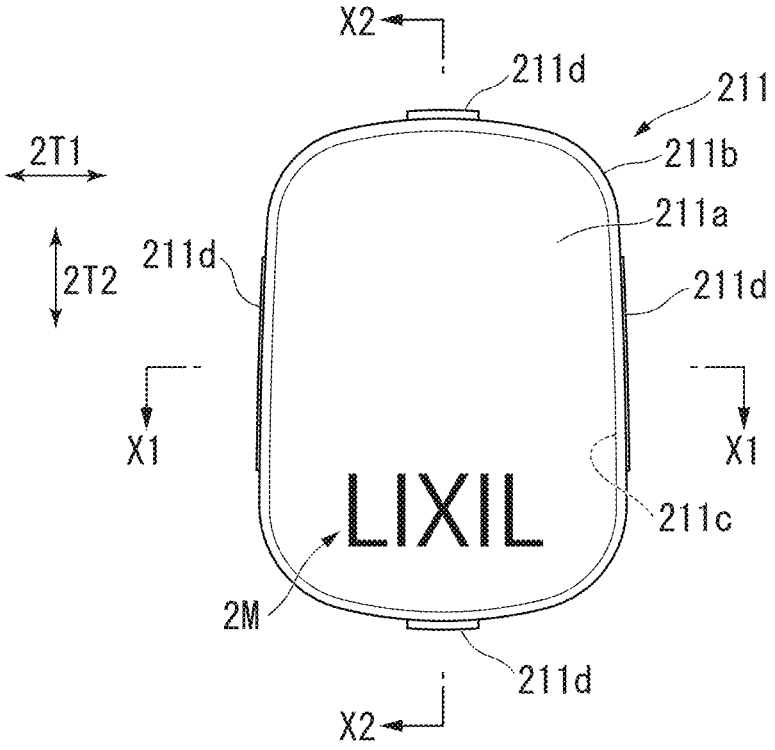
FIG. 17A is a plan view illustrating a sensor window main body of the sensor window according to embodiment B of the present invention.
Figure 17B:
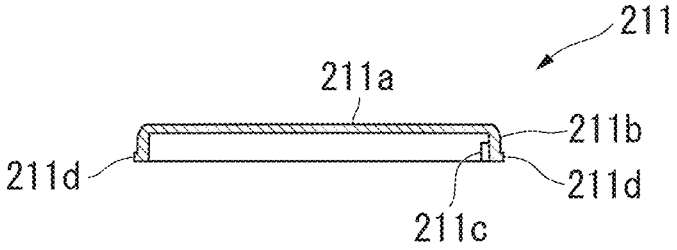
FIG. 17B is a view seen along the X1-X1 line arrow in FIG. 17A.
Figure 17C:
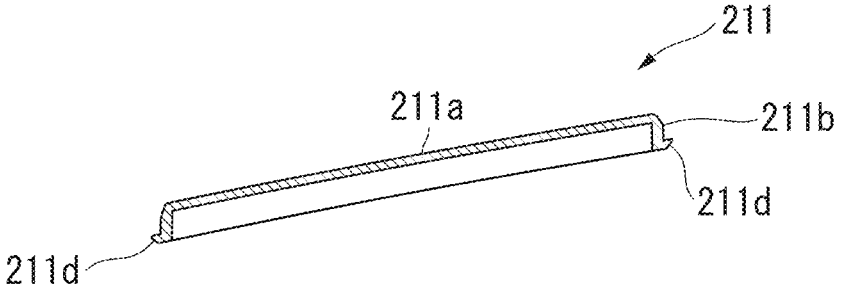
FIG. 17C is a view seen along the X2-X2 line arrow in FIG. 17A.
Figure 18A:
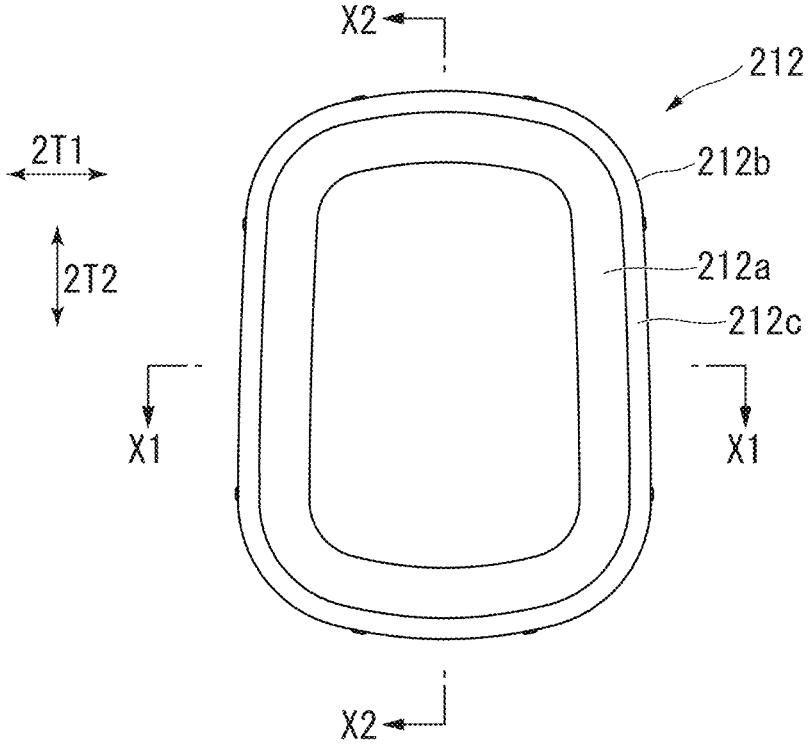
FIG. 18A is a plan view illustrating a window attachment member of the sensor window according to embodiment B of the present invention.
Figure 18B:
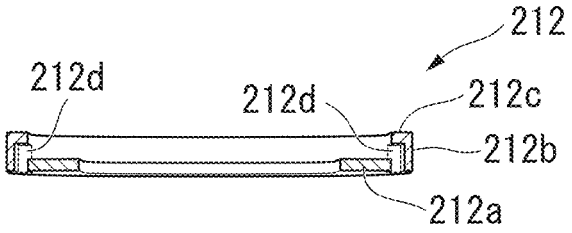
FIG. 18B is a view seen along the X1-X1 line arrow in FIG. 18A.
Figure 18C:
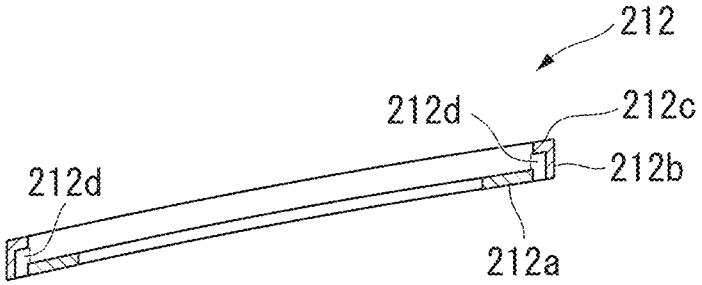
FIG. 18C is a view seen along the X2-X2 line arrow in FIG. 18A.

As shown in FIG. 14 and FIG. 15, the sensor window 26 is configured to include a window-holding member 210, a sensor window main body 211, and a window attachment member (inner member) 212.

The window-holding member 210 is formed into a substantially rectangular ring shape. The sensor window main body 211 is formed into a lid shape such that the window-holding member 210 is fitted from above and is integrally attached thereto. The window attachment member 212 is formed into a substantially rectangular ring shape which is a shape substantially similar to and slightly larger than that of the window-holding member 210. The sensor window main body 211 and the window-holding member 210 are fitted from above and are integrally attached thereto.

The window-holding member 210 is, for example, a resin molded product. As shown in FIG. 14, FIG. 15, and FIG. 16A to FIG. 16C, the window-holding member 10 is formed into a substantially rectangular ring shape and is formed to include a side wall portion 210*a* which protrudes upward from an outer circumferential end and extends in a circumferential direction. An engagement recess portion 210*b* that is recessed inward from the outer surface is provided in the side wall portion 210*a* of the window-holding member 210.

The sensor window main body 211 is a translucent resin molded product. As shown in FIG. 14, FIG. 15, and FIG. 16A to FIG. 16C, in a state where the window-holding member 210 is fitted and is integrally attached thereto, the sensor window main body 211 is formed into a substantially C-shape in a cross section and includes a sensor window portion 211*a* and a fitting wall portion 211*b*. The sensor window portion 211*a* has a plate shape covering a middle hole of the window-holding member 210 and the opening portion 27 from above. The fitting wall portion 211*b* protrudes downward from the outer circumferential end of the sensor window portion 211*a* and extends in the circumferential direction.

An inner engagement projection portion 211*c* protruding to inward from the inner surface and an outer engagement projection portion 211*d* protruding outward from the outer surface are provided in the fitting wall portion 211*b* of the sensor window main body 211. While the engagement recess portion 210*b* of the side wall portion 210*a* and the inner engagement projection portion 211*c* of the fitting wall portion 211*b* engage with each other, the side wall portion 210*a* is fitted such that the side wall portion 210*a* overlaps with the inner side of the fitting wall portion 211*b*. Accordingly, the window-holding member 210 is integrally attached to the sensor window main body 211.

The sensor window main body 211 (and the window-holding member 210) is formed such that its width dimensions in the width direction 2T1 gradually increases from the rear end, i.e., the far end, toward the front end, i.e., the end closer to the user along the forward/rearward direction 2T2. In the sensor window main body 211, the sensor window portion 211*a* is formed into a projected arc shape in a lateral cross-sectional view, the center of the arc being at the center in the width direction 2T1. The sensor window main body 211 is formed into a projected arc shape in a vertical cross-sectional view, the center of the arc substantially being at the center (slightly forward than the center) in the forward/rearward direction 2T2.

Moreover, in embodiment B, a logo (mark) 2M such as a manufacturer or a product name is printed on the upper surface of the sensor window portion 211*a* of the sensor window main body 211 at a front portion, wherein the width is wider. A mark such as a logo may be adhered on the sensor window portion 211*a* as a sticker or the like.

The sensor window main body 211 is made of resin such as high density polyethylene, which has low adhesion with respect to ink, an adhesive, and the like. Accordingly, there is a concern that abrasion resistance or the like of the logo (mark) 2M may not be enough if a general printing step is performed by itself. Therefore, in embodiment B, surface modification treatment is performed as treatment prior to a printing step to the portion being subjected to the printing (i.e., upper surface) of the sensor window main body 211. Examples of such surface modification treatment include frame treatment, plasma discharge treatment, ultraviolet irradiation treatment, and corona discharge treatment. A logo is printed by using ink having strong and significant adhesiveness or the like with respect to a resin material having bottom surface energy.

As shown in FIG. 14, FIG. 15, and FIG. 18A to FIG. 18C, the window attachment member 212 is formed to include an attachment portion 212*a*, a side wall portion 212*b*, and a decorative portion 212*c*. The attachment portion 212*a* is formed into a substantially rectangular ring shape slightly larger than the window-holding member 210. The side wall portion 212*b* protrudes upward from the outer circumferential end of the attachment portion 212*a* and extends in the circumferential direction. The decorative portion 212*c* protrudes inward in the width direction 2T1 from the upper end of the side wall portion 212*b* and extends in the circumferential direction to form a center hole in an outer circumferential shape (shape in the plan-view) having a size substantially equal to that of the sensor window main body 211.

In embodiment B, at least the upper surface of the decorative portion 212*c* of the window attachment member 212 is subjected to plating treatment. The decorative portion 212*c* may be formed by performing other types of decorative treatment such as mirror surface treatment and coloring with suitable color.

An engagement recess portion 212*d* is provided on the inner side of the window attachment member 212. The window attachment member 212 integrally attached to the sensor window main body 211 and the window-holding member 210, while the outer engagement projection portion 211*d* of the sensor window main body 211 and the engagement recess portion 212*d* of the window attachment member 212 engage with each other and the sensor window main body 211 and the window-holding member 210 are fitted into the middle hole from above.

In embodiment B, the window-holding member 210 and the upper surface of the attachment portion 212*a* of the window attachment member 212 are bonded to each other by using a double-sided tape 213 or the like, thereby being firmly integrated together.

On the other hand, as shown in FIG. 14, the opening portion 27 formed to penetrate the cover case 24 from the upper surface 24*b* to the inner surface 24*c* is provided in a sensor window attachment portion 215 at the center of the cover case 24 in the width direction 2T1, to which the sensor window 26 is attached. The opening portion 27 is located inward away from the upper surface 24*b* of the cover case 24 by the length of the step portion 24*d*. The step portion 24*d* extends with a predetermined length to the inner side below from the upper surface 24*b* of the cover case 24. The attachment seat portion 24*e* extends in the traverse direction from the lower end of the step portion 24*d* and extends in the circumferential direction. The opening portion 27 is thereby formed by the attachment seat portion 24*e*.

As shown in FIG. 13 and FIG. 14 (FIG. 15), the sensor window 26 includes the sensor window main body 211, the window-holding member 210, and the window attachment member 212 integrated therein. In the sensor window 26, the window attachment member 212 is fitted into the sensor window attachment portion 215 from above, and the sensor window 26 is attached to a portion at the center of the cover case 24 in the width direction 2T1. In this configuration of the sensor window 26, the upper surface of the attachment seat portion 24*e* of the sensor window attachment portion 215 and the lower surface of the attachment portion 212*a* of the window attachment member 212 are bonded to each other by using a double sided tape 216 or the like, thereby being firmly attached to the cover case 24.

In a state where the sensor window 26 is attached to the sensor window attachment portion 215 of the cover case 24, the opening portion 27 formed in the cover case 24 is covered with the translucent sensor window portion 211*a*, and the sensor window portion 211*a* is installed to slightly protrude upward from the upper surface 24*b* of the cover case 24.

Moreover, in a state where the sensor window 26 is attached to the sensor window attachment portion 215, the decorative portion 212*c* of the window attachment member 212 is installed along a connecting portion (i.e., an engaging portion, or the boundary part) of the sensor window 26 and the sensor window attachment portion 215 of the cover case 24.

Next, as shown in FIG. 14, the human body detection sensor 25 such as a pyroelectric sensor is provided inside the cover case 24 in a fixed manner. The human body detection sensor 25 has a predetermined detection range in front of the toilet device 2A, and performs the detection through the opening portion 27 and the sensor window portion 211*a* from inside. In this case, the human body detection sensor 25 is attached to a sensor fixing boss 217 integrated with the attachment seat portion 24*e* of the sensor window attachment portion 215, thereby being positionally aligned at a predetermined position and a predetermined angle and being installed in a fixed manner.

The human body detection sensor 25 of embodiment B is provided to detect a human body through a region having no logo 2M, the region located upper than the region in which the logo 2M is printed on the lower end side of the sensor window portion 211*a*.

Moreover, in embodiment B, the logo 2M (at least a part of the logo 2M) is provided at a position facing the attachment seat portion 24*e* of the sensor window attachment portion 215, that is, a position overlapping the attachment seat portion 24*e* thereof in the upward/downward direction.

In the toilet device 2A of embodiment B, the sensor window 26 is arranged at the center of the cover case 24 in the width direction 2T1, and the logo (mark) 2M is formed in the sensor window portion 211*a*. Therefore, it is possible to integrally provide the logo 2M such as a brand logo and a product logo, and the sensor window 26 which have been individually scattered and had been functionally disconnected from each other in the related art. Accordingly, the appearance design of the toilet device 2A can be improved.

In embodiment B, the sensor window 26 and the human body detection sensor 25 are provided at the center, instead of at the side portion of the toilet device 2A in the width direction 2T1 as in the related art. Accordingly, a detection range 2H can be set to be wider than that in the related art, so that the detection accuracy can be enhanced.

In embodiment B, the sensor window 26 is attached to the sensor window attachment portion 215, and the decorative portion 212*c* of the window attachment member 212 of the sensor window 26 is installed along the connecting portion of the sensor window 26 and the sensor window attachment portion 215 of the cover case 24. Accordingly, the outer circumference of the sensor window portion 211*a* is formed to be fringed by the decorative portion 212*c* which is subjected to plating treatment, such that a favorable appearance can be achieved. That is, since the logo 2M is provided in the sensor window portion 211*a* and the outer circumference is fringed by the decorative portion 212*c*, the sensor window 26 can be finished like an emblem while being unrecognizable as the sensor window 26. Accordingly, the appearance design can be further improved.

In embodiment B, the sensor window 26 is provided such that the sensor window portion 211*a* protrudes outward than the upper surface (surface) 24*b* of the cover case 24. Accordingly, the logo 2M becomes more noticeable, and the sensor window 26 becomes less apparent to be a sensor window.

The brand of a product can be easily changed by only changing the logo (mark) 2M provided in the sensor window 26, so that it is possible to easily cope with OEM products or the like, for example.

Moreover, since the sensor window 26 is configured to be fitted into the sensor window attachment portion 215 (opening portion 27) from the outer side of the cover case 24, e.g., the outer side of the toilet device 2A, and is configured to be attached in an attachable/detachable manner. Accordingly, there is no need to provide a holding member on the inner side as in the related art. Accordingly, the sensor window 26 can be easily attached and detached, and the number of members can also be reduced.

Since the sensor window 26 is configured to include the window-holding member 210 (and/or the window attachment member 212) in addition to the sensor window main body 211, the strength of the sensor window 26 can be favorably ensured.

Since the sensor window portion 211*a* protrudes outward from the surface of the cover case 24, the human body detection sensor 25 (sensor substrate) or the like can be arranged upward in accordance with its protruding amount. In other words, the human body detection sensor 25 or the like can be arranged close to the opening portion 27.

Accordingly, the degree of freedom for a layout inside the cover case 24 can be improved and the human body detection sensor 25 can be arranged close to the sensor window portion 211*a*. Therefore, the detection range 2H can become further wider and the detection accuracy can be further improved.

Due to the decorative portion 212*c*, even if the sensor window portion 211*a* protrudes outward from the surface of the cover case 24, it is possible to have a favorable appearance. In other words, since the decorative portion 212*c* is provided, there is no need to bring surfaces of the sensor window portion 211*a* and the cover case 24 into flush with each other, so that the restriction on attachment of the sensor window 26 can be reduced.

Moreover, in embodiment B, since the sensor window portion 211*a* is formed into a projected arc shape in a lateral cross-sectional view and a vertical cross-sectional view, the human body detection sensor 25 (sensor substrate) or the like can be arranged at a further upper position. In this respect as well, the detection range 2H can be widened and the detection accuracy can be improved.

Since the sensor window portion 211*a* is formed such that its width increases from the rear end toward the front end, the detection range 2H for the human body detection sensor 25 can be further widened and the detection accuracy can be further improved.

Hereinabove, an embodiment of the toilet device according to the present invention has been described. However, the present invention is not limited to embodiment B and can be suitably changed within a range not departing from the gist thereof.

For example, in embodiment B, the sensor window 26 (and the human body detection sensor 25) according to the present invention is attached to the upper surface 24*b* side and at the center of the cover case 24. However, the sensor window 26 (and the human body detection sensor 25) may be provided in a different portion of the cover case 24 or in a different outer shell body forming an outer shell of the toilet device 2A other than the cover case 24.

A pattern or the like may be displayed in the sensor window portion 211*a* of the sensor window 26, instead of the logo 2M. That is, there is no need to limit the type of the mark 2M to be displayed in the sensor window portion 211*a* to a logo. Moreover, as long as the human body detection sensor 25 can detect a person, the mark 2M to be displayed in the sensor window portion 211*a* may be provided to overlap the detection range 2H for the human body detection sensor 25.

In embodiment B, description has given based on the configuration in which the toilet device according to the present invention includes the toilet main body 21, the washing mechanism unit 22, and the toilet seat unit 23 including the toilet seat 23*a* and the toilet lid 23*b*. In this respect, the toilet device according to the present invention may be configured to include a human body detection system 2B at least including a sensor window and a human body detection sensor. For example, the toilet device according to the present invention may be configured to have the washing mechanism unit 22, the toilet seat unit 23 including the toilet seat 23*a* and the toilet lid 23*b*, the cover case 24, and the human body detection system 2B.

REFERENCE SIGNS LIST

11 toilet device
12 toilet main body
13 functional unit
14 base plate
15 cover
19 gasket
121 toilet bowl
122 functional unit installation space
125 recess portion
131 private part-washing device
132 shutter
157 protrusion portion
1571 cut-out portion
21 toilet main body
22 washing mechanism unit
23 toilet seat unit
23*a* toilet seat
23*b* toilet lid
24 cover case (outer shell body)
24*a* cover (outer shell body)
24*b* upper surface (surface, outer surface)
24*c* lower surface (inner surface)
24*d* step portion
24*e* attachment seat portion
25 human body detection sensor
26 sensor window
27 opening portion
210 window-holding member
210*a* side wall portion
210*b* engagement recess portion
211 sensor window main body
211*a* sensor window portion
211*b* fitting wall portion
211*c* inner engagement projection portion
211*d* outer engagement projection portion
212 window attachment member (inner member)
212*a* attachment portion
212*b* side wall portion
212*c* decorative portion
212*d* engagement recess portion
213 double sided tape
215 sensor window attachment portion
216 double sided tape
2A toilet device
2B human body detection system
2M logo (mark)
2O1 pivot shaft
2T1 width direction
2T2 forward/rearward direction

The invention claimed is:

1. A toilet device, comprising:
a toilet main body;
a base plate which is provided on an upper portion of the toilet main body and on which a functional unit is mounted; and
a cover which covers the base plate from an upper side such that the functional unit is accommodated,
wherein the cover has a protrusion portion that protrudes downward and that is positioned closer to a toilet bowl of the toilet main body than the base plate, and
a front surface of the protrusion portion is arranged to be substantially continuous with or substantially co-planer with a part of an inner surface of the toilet bowl adjacent to the protrusion portion in a width direction.

2. The toilet device of claim 1, wherein a recess portion, which communicates with the toilet bowl and is recessed downward from an upper end surface of the toilet main body, is formed in the toilet main body, and wherein the base plate is arranged on the recess portion.

3. The toilet device of claim 1,
wherein a gasket is provided in a gap between the toilet main body and the base plate, and
wherein the protrusion portion is arranged at a position closer to the toilet bowl than the gasket.

4. The toilet device of claim 1,
wherein the functional unit has a private part-washing device,
wherein the private part-washing device has a shutter provided at a position facing the toilet bowl, and
wherein a cut-out portion, in which the shutter is arranged, is formed in the protrusion portion.

5. A toilet device, comprising:
a toilet main body;
a base plate which is provided on an upper portion of the toilet main body and on which a functional unit is mounted; and
a cover which covers the base plate from an upper side such that the functional unit is accommodated,
wherein the cover has:
a protrusion portion that protrudes downward and that is positioned closer to a toilet bowl of the toilet main body than the base plate; and
a lower plate portion, and
wherein the protrusion portion is formed into a plate shape protruding downward from a front edge portion of the lower plate portion.

* * * * *